US010944213B2

(12) United States Patent
Su

(10) Patent No.: US 10,944,213 B2
(45) Date of Patent: Mar. 9, 2021

(54) USB COMBINATION LOCK FOR ELECTRONIC DEVICES

(71) Applicant: Jason Su, Changhua (TW)

(72) Inventor: Jason Su, Changhua (TW)

(73) Assignee: INGMAR CO. LTD., Changhua (TW)

( * ) Notice: Subject to any disclaimer, the term of this patent is extended or adjusted under 35 U.S.C. 154(b) by 0 days.

(21) Appl. No.: 14/918,105

(22) Filed: Oct. 20, 2015

(65) Prior Publication Data

US 2017/0110831 A1 Apr. 20, 2017

(51) Int. Cl.

| | |
|---|---|
| ***H01R 13/639*** | (2006.01) |
| ***E05B 37/02*** | (2006.01) |
| *E05B 37/00* | (2006.01) |

(52) U.S. Cl.

CPC ..... *H01R 13/6392* (2013.01); *E05B 37/02* (2013.01); *H01R 13/639* (2013.01)

(58) Field of Classification Search

CPC ..... Y10T 70/5009; Y10T 70/40; Y10T 70/50; Y10T 70/796; Y10T 70/7983; Y10T 70/415; E05B 73/0082; E05B 73/0005; E05B 37/02; E05B 37/0058; E05B 67/003; H01R 13/6397; H01R 2201/06; H01R 70/58; H01R 13/639; H01R 13/6392; H01R 13/6395

USPC ..... 70/14, 15, 18, 57, 58, 312, 314, 315; 439/133, 135

See application file for complete search history.

(56) References Cited

U.S. PATENT DOCUMENTS

| | | | | |
|---|---|---|---|---|
| 5,190,466 | A * | 3/1993 | McVey | H01R 13/60 439/133 |
| 6,058,744 | A * | 5/2000 | Ling | E05B 37/025 70/28 |
| 7,160,137 | B1 * | 1/2007 | Yeh | H01R 13/6397 439/358 |
| 7,581,417 | B1 * | 9/2009 | Chen | E05B 37/025 439/133 |
| 7,677,065 | B1 * | 3/2010 | Miao | E05B 37/02 439/133 |
| 7,913,527 | B2 * | 3/2011 | Chen | E05B 37/02 439/133 |
| 8,671,721 | B2 * | 3/2014 | Yu | E05B 37/025 70/14 |
| 8,833,117 | B2 * | 9/2014 | Yang | E05B 37/025 70/14 |
| 2004/0093916 | A1 * | 5/2004 | Ling | H01R 13/6397 70/58 |

(Continued)

*Primary Examiner* — James Harvey
*Assistant Examiner* — Matthew T Dzierzynski
(74) *Attorney, Agent, or Firm* — Che-Yang Chen; Law Offices of Scott Warmuth

(57) ABSTRACT

A USB combination lock for an electronic device may include a lock rod, a shell body, a USB connector, a push button, and a lock piece. The USB connector can be directly inserted into the USB port of the electronic the electronic device, and the blocking portion of the USB connector can be engaged with the USB port. When the push button is in a released position, the lock piece will block a bottom portion of the hooking member of the USB connector, and the lock piece will not be pressed inwardly by the blocking portion. Thus, by shifting the numeral wheels, the connecting piece can be turned into the lock position, leading to the combination lock of present invention achieving the burglarproof effect.

6 Claims, 7 Drawing Sheets

(56) References Cited

U.S. PATENT DOCUMENTS

| | | | | |
|---|---|---|---|---|
| 2006/0134962 | A1* | 6/2006 | Yeh | H01R 13/6271<br>439/352 |
| 2007/0277566 | A1* | 12/2007 | Yu | E05B 73/0005<br>70/58 |
| 2010/0307204 | A1* | 12/2010 | Yu | E05B 37/025<br>70/58 |
| 2014/0130555 | A1* | 5/2014 | Clark | E05B 35/008<br>70/58 |

* cited by examiner

USB COMBINATION LOCK FOR ELECTRONIC DEVICES

FIELD OF THE INVENTION

The present invention relates to a USB combination lock for electronic devices, and more particularly to a USB combination lock that can plug in a USB slot of the electronic device to prevent the electronic device from being stolen.

BACKGROUND OF THE INVENTION

Nowadays, it is common to see 3C products, such as desktop computers, laptops and etc., placed in public place for public use. For example, the computer classrooms provide computers for students to achieve teaching purpose, and the places like libraries, government offices, or shopping malls also place electronic devices, especially laptops, for public use. However, according to statistics, since the volumes of most of recent electronic devices are small, they are easy to be moved or stolen. Thus, the electronic devices placed in public need to be locked by a locker to prevent them from stealing, or to manage them effectively.

However, the conventional lock for electronic device is disadvantageous because: (i) electronic devices today, such as laptops, are a great variety of types, and the design of lock holes in different laptops are also different. Further, there is some laptops even without a lock hole. Thus, the conventional lock cannot be applied in these kinds of laptops; and (ii) because of most of electronic devices transmitting data through theirs USB ports, when the electronic devices are placed in public places, the data stored in the electronic devices are more likely to be stolen by people with bad intention through a USB or a portable external hard drive. Moreover, electronic devices are inclined to be infected by viruses through an unsafe USB inserted by a user, resulting in electronic devices being dysfunctional or broken. Therefore, there remains a need for a new and improved design for a lock for electronic device to overcome the problems presented above.

SUMMARY OF THE INVENTION

The present invention provides a USB combination lock for electronic device, which comprises a lock rod, a shell body, a USB connector, a push button, and a lock piece. The lock rod comprises multiple numeral wheels side by side disposed thereon, and a first end of the lock rod is connected to a connecting piece. Also, a spring is formed between the connecting piece and the numeral wheels. A first end of the connecting piece closing to the spring has a sloping portion, and a second end thereof which is away from the spring comprises an engaging portion. A first through hole located between the sloping portion and the engaging portion is formed at a central portion of the connecting piece. The shell body has two symmetric shell pieces covering round outside of the lock rod, and an inside space of the shell body along a direction of lock rod has an accommodating space and a shifting space which are connected to each other. The accommodating space is configured to accommodate the numeral wheels, and the shifting space is configured to accommodate the connecting piece. A sliding groove horizontally penetrating the shifting space is formed on the shell body, and the sliding groove comprises an actuating opening formed at a surface thereof. A fixing slot formed on the shell body is connected to the shifting space, and a bolt opening extended from the fixing slot is formed on a surface of a first end of the shell body. An inner wall of the fixing slot comprises a plurality of protruding pieces and at least a recessed portion, and a second through hole is formed at a second end of the shell body. A second end of the lock rod comprises a fixing rod which is configured to connect to a locking cable, and the locking cable can be twined around immovable object to achieve a burglarproof effect. The USB connector is secured in the fixing slot of the shell body, and a plurality of connecting holes formed on the USB connector is connected to the protruding pieces. Thus, the USB connector can protrude from the bolt opening. Also, at least an elastic hooking member formed on a surface of the USB connector is curved toward an inner space of the USB connector. A rear end of the hooking member has a blocking portion, and a push button is located on the sliding groove of shell body. Also, a head portion of the push button protrudes from the actuating opening. The push button penetrates through the first through hole of the connecting piece, and an elastic member bears against a first end of the push button. Thus, the connecting piece can be pushed by the push button to axially move in the shell body. A sloping surface facing to the sloping portion of the connecting piece is formed at a side of the push button, and is configured to bear against the sloping portion to move the connecting piece. The lock piece is located inside of the USB connector, and an evading opening is formed at a first end of the lock piece. Moreover, a second end of the lock piece has a connecting portion, which is configured to engage with the engaging portion of the connecting piece. In one embodiment, the engaging portion of the connecting piece and the connecting portion of the lock piece are engaged with each other in a method of dovetail joint. Thus, the connecting piece and the lock piece can quick connect to each other, and also the dovetail joint can prevent the connection between the connecting piece and the lock piece from axial disengagement. Furthermore, the second end of the lock piece has at least an elastic unit formed inside of the recessed portion of the shell body.

Comparing with conventional combination lock, the present invention is advantageous because: (i) since the lock piece is moved to align the evading opening with the hooking member of the USB connector, the blocking portion of the hooking member can be pressed toward the inside of the USB connector. Thus, the USB connector can be directly inserted into the USB port of the electronic device, and the blocking portion of the USB connector can be engaged with the USB port. When the push button is in a released position, the lock piece will block a bottom portion of the hooking member of the USB connector, and the lock piece will not be pressed inwardly by the blocking portion. Thus, by shifting the numeral wheels, the connecting piece can be turned into the lock position, leading to the combination lock of present invention achieving the burglarproof effect; and (ii) when the USB connector is inserted into the USB port of the electronic device, the lock piece can be secured by the lock rod, which is in the lock position. Thus, the lock piece can block the hooking member, and the blocking portion can engage with the USB port to achieve the burglarproof effect. Also, when the USB combination lock is connected to an electronic device, the USB port will be occupied. Thus, it can prevent date in electronic device from being copied by a USB or a portable external hard. Furthermore, since the USB port is occupied, the electronic device will be less chance to be infected by an unsafe USB or an unsafe portable external hard drive. As a result, the USB combination lock of present invention can provide additional layer of security for the electronic device.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
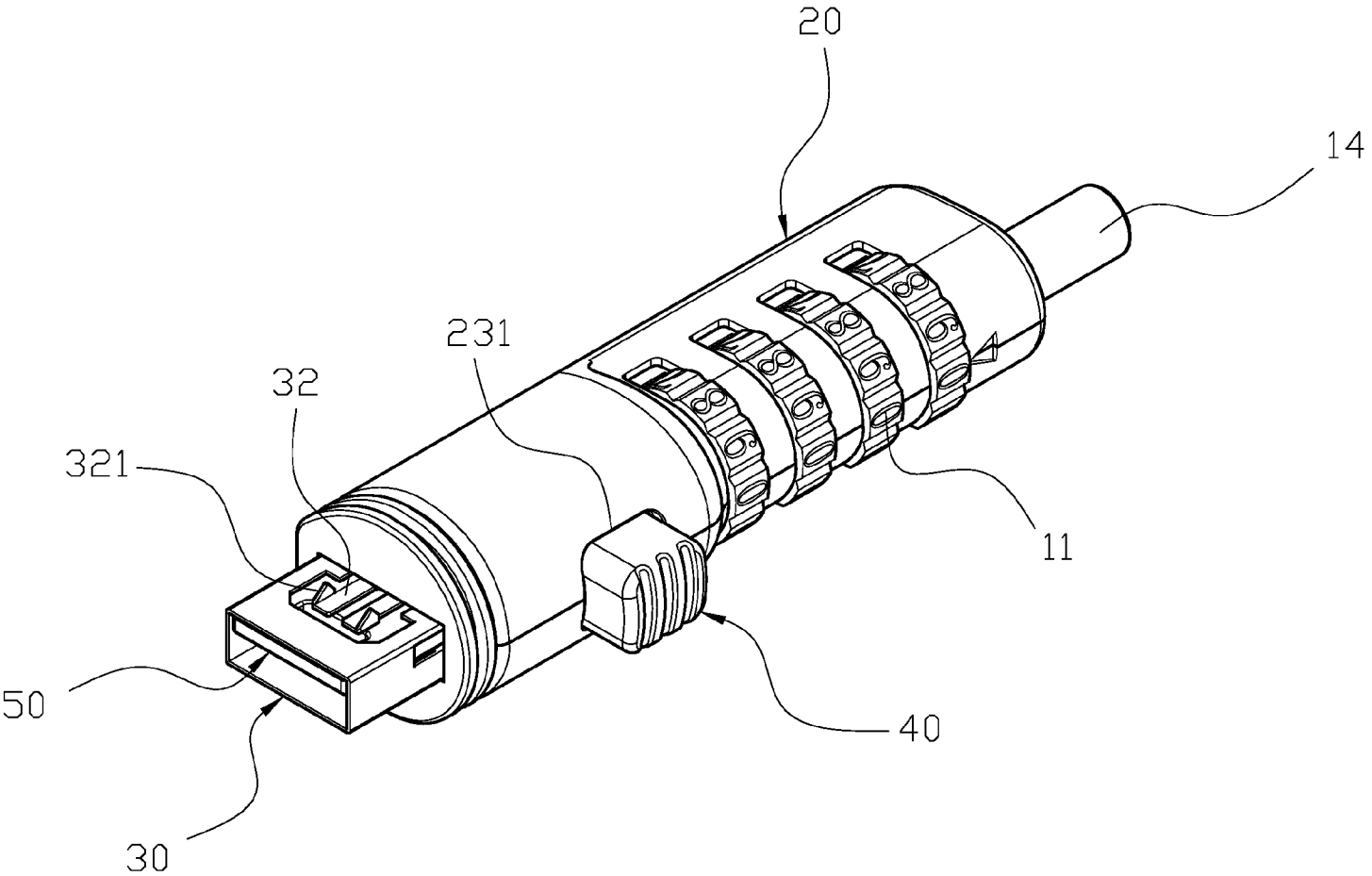
FIG. 1 is a three-dimensional view of the USB combination lock for electronic devices of present invention.
Figure 2:
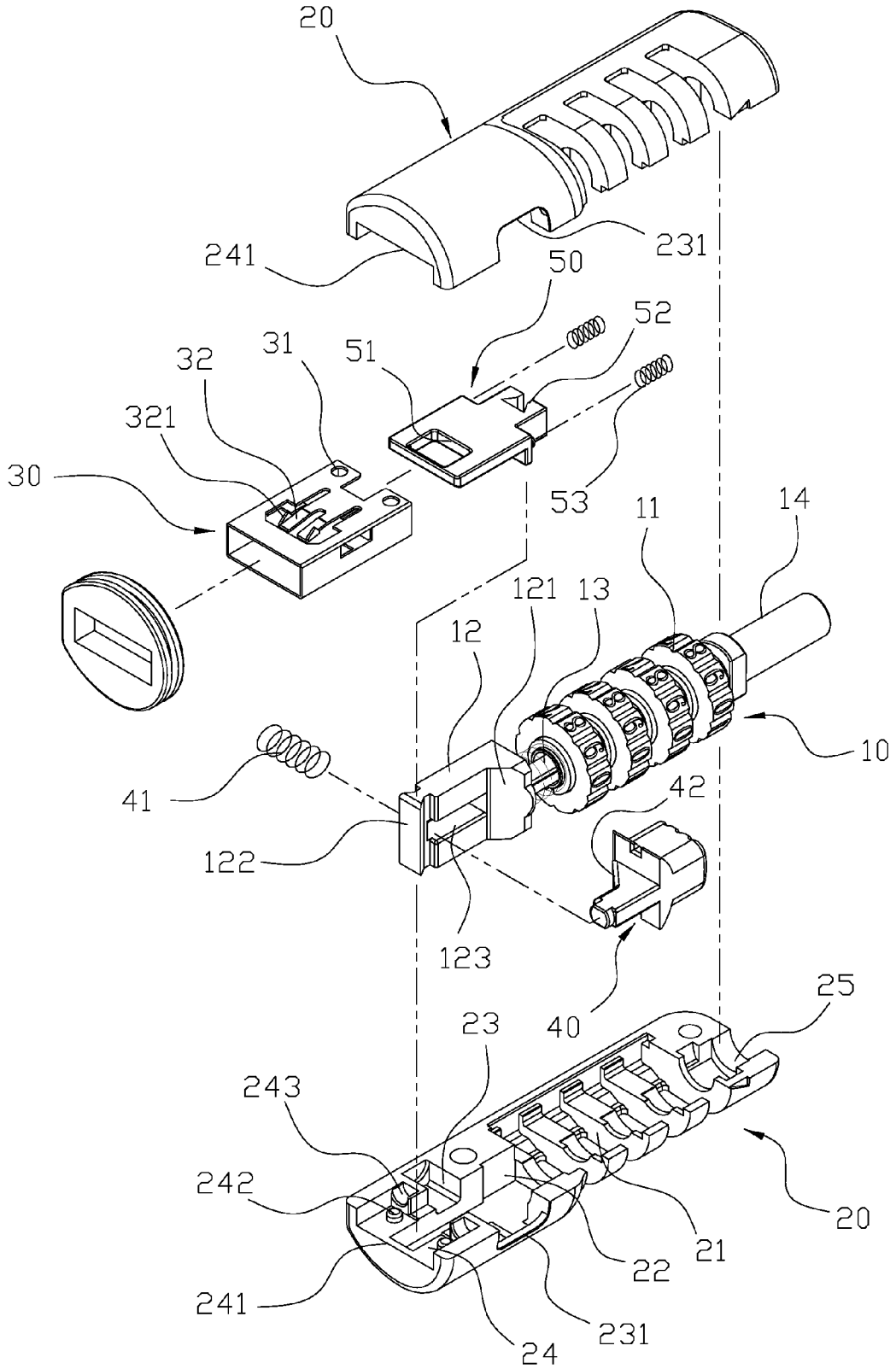
FIG. 2 is a three-dimensional, exploded view of the USB combination lock for electronic devices of present invention.
Figure 3:
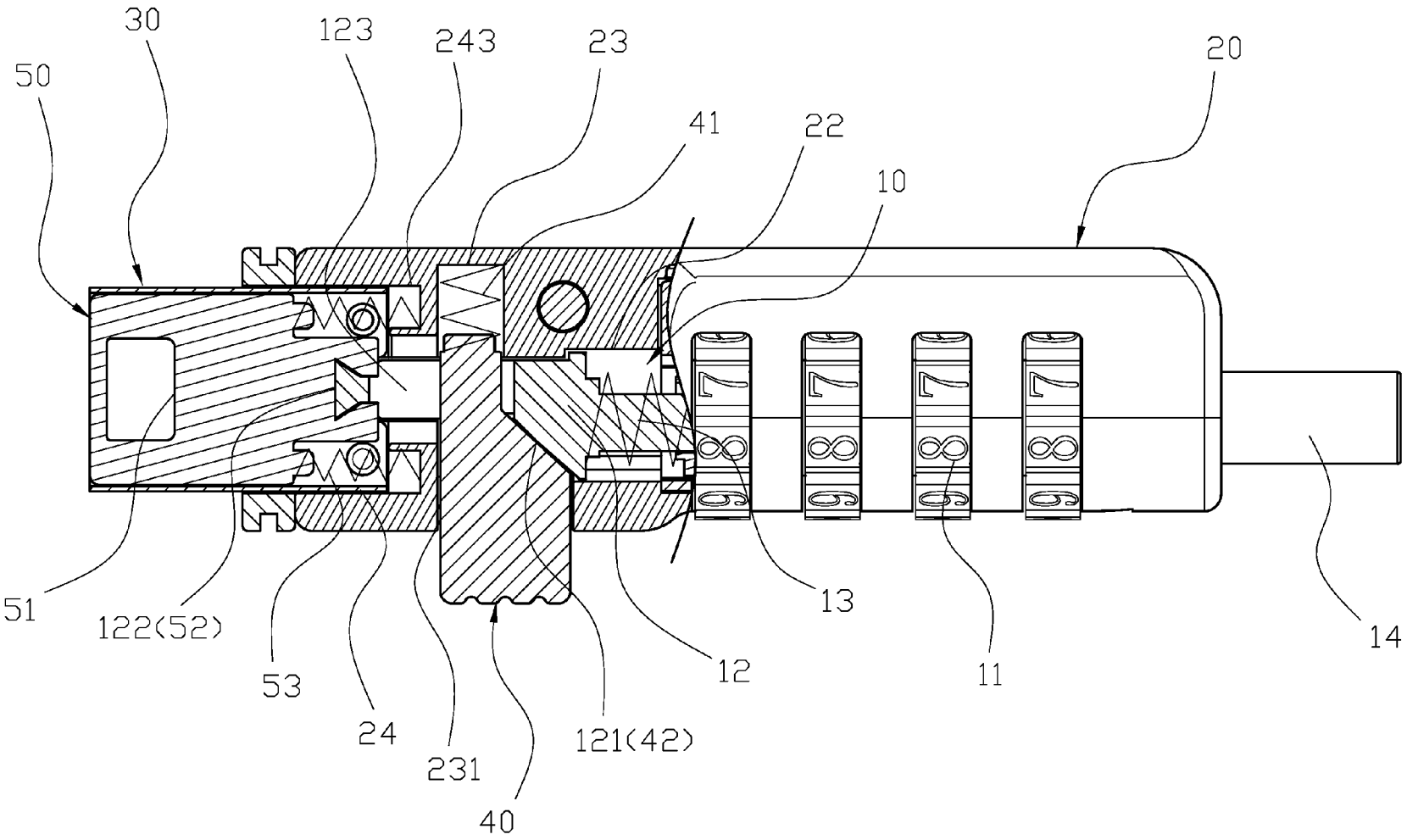
FIG. 3 is a sectional view of the USB combination lock for electronic devices of present invention.
Figure 4:
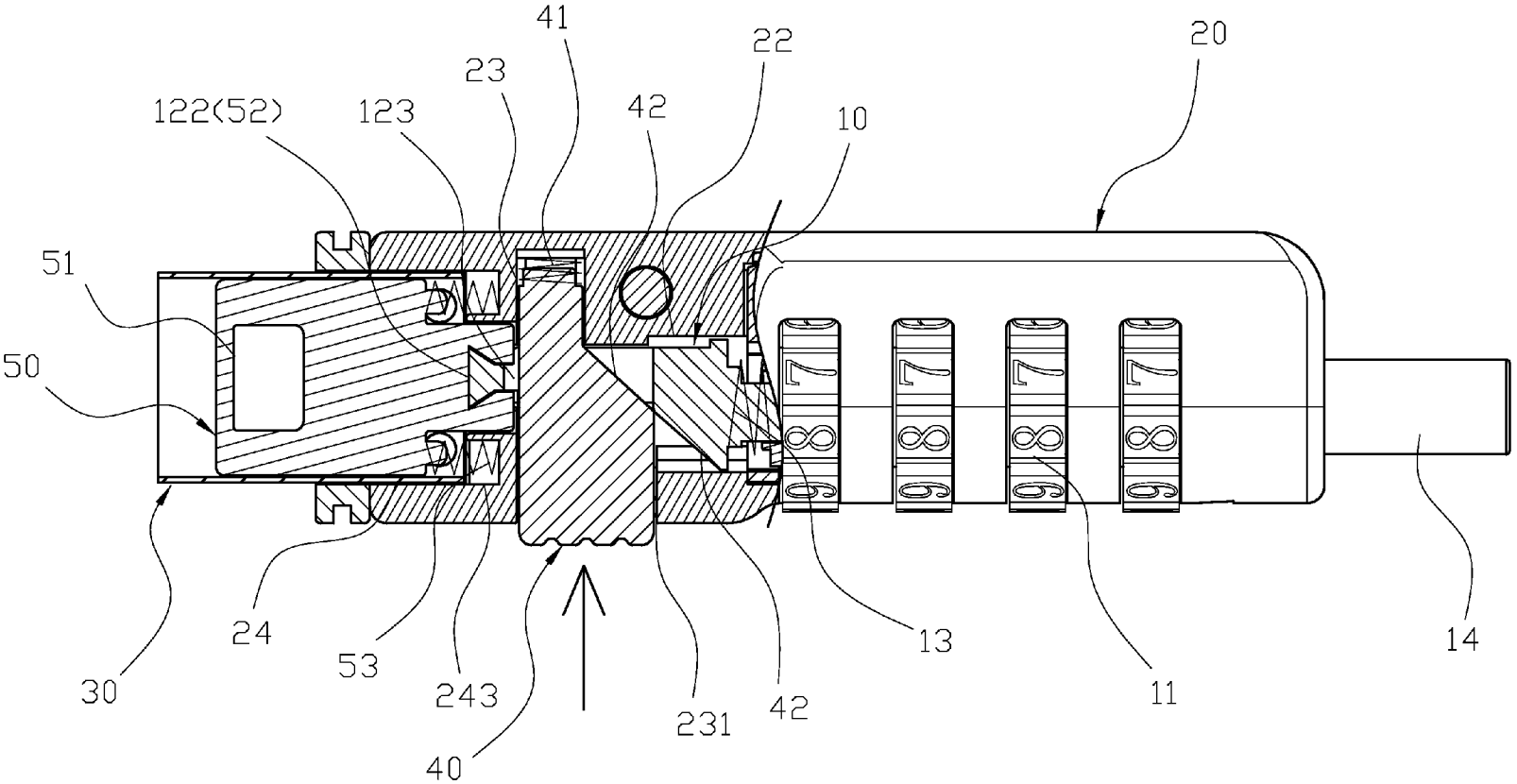
FIG. 4 is a schematic view of the USB combination lock for electronic devices of present invention.
Figure 5:
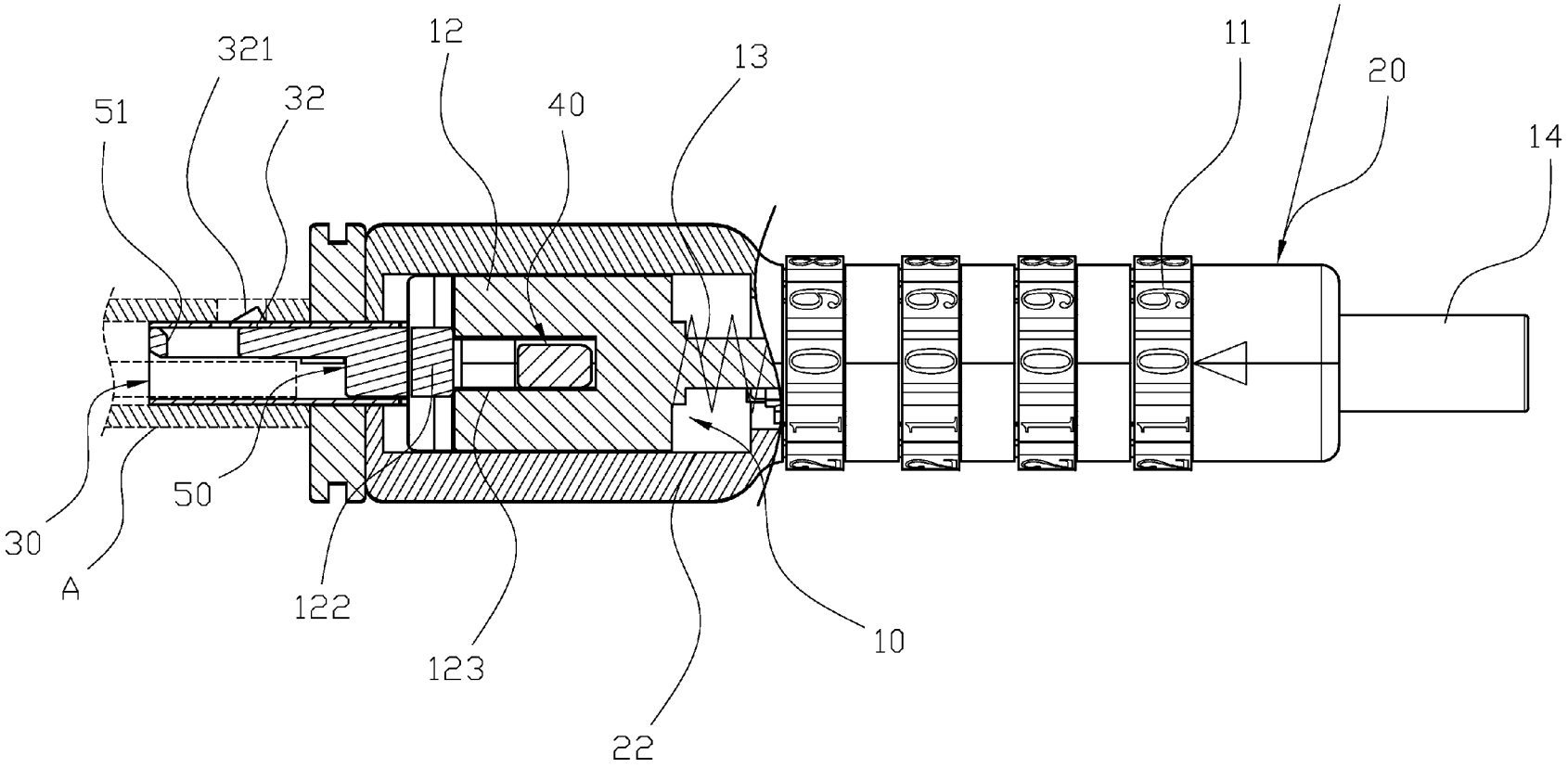
FIG. 5 is another schematic view of the USB combination lock for electronic devices of present invention.
Figure 6:
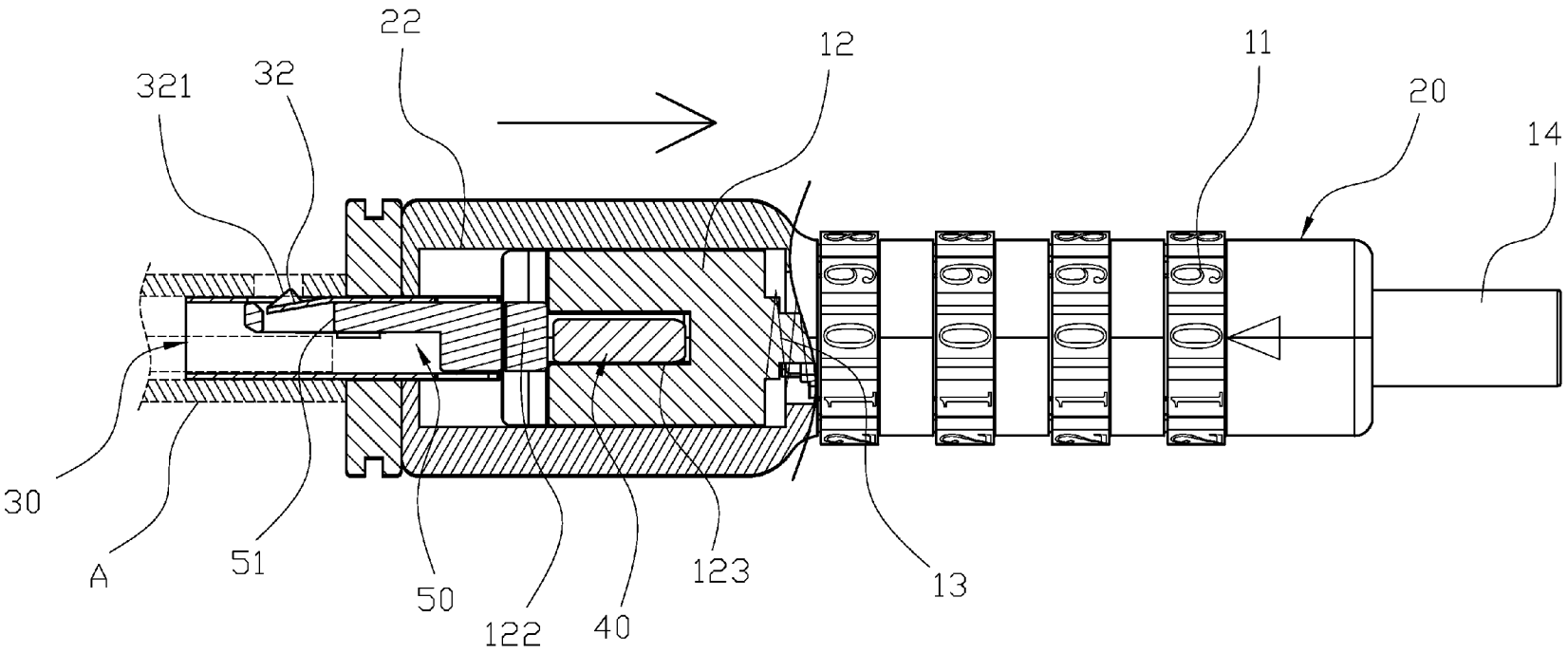
FIG. 6 is still another schematic view of the USB combination lock for electronic devices of present invention.
Figure 7:
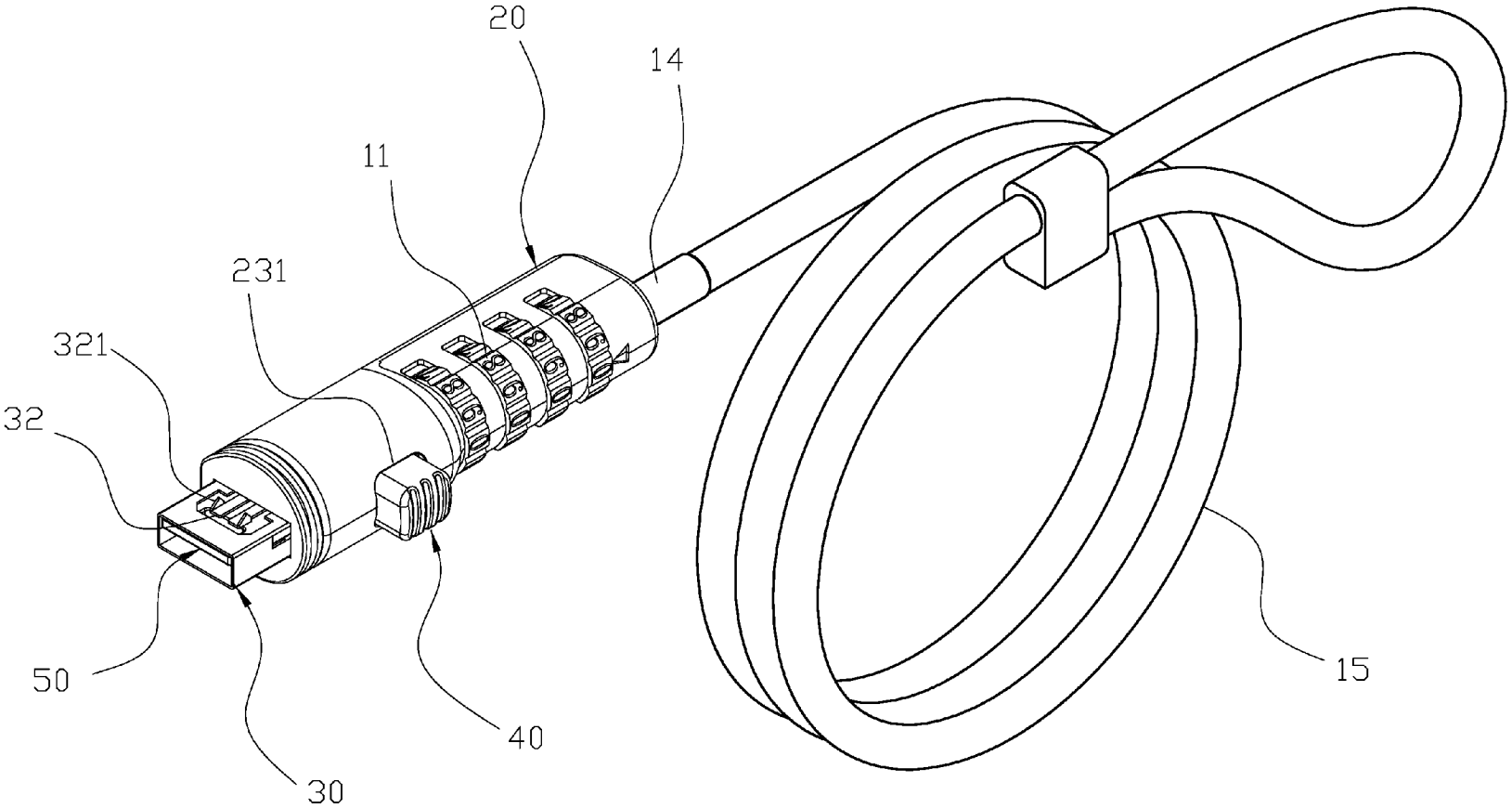
FIG. 7 is a schematic view when a locking cable is connected to the USB combination lock for electronic devices of present invention.

In order to further understand the goal, characteristics and effect of the present invention, a number of embodiments along with the drawings are illustrated as following:

Referring to FIGS. 1 to 3, the present invention provides a USB combination lock for an electronic device, which comprises a lock rod (10), a shell body (20), a USB connector (30), a push button (40), and a lock piece (50), The lock rod (10) comprises multiple numeral wheels (11) side by side disposed thereon, and a first end of the lock rod (10) is connected to a connecting piece (12). Also, a spring (13) is formed between the connecting piece (12) and the numeral wheels (11). A first end of the connecting piece (12) closing to the spring (13) has a sloping portion (121), and a second end thereof which is away from the spring (13) comprises an engaging portion (122). A first through hole (123) located between the sloping portion (121) and the engaging portion (121) is formed at a central portion of the connecting piece (12). The shell body (20) has two symmetric shell pieces covering round outside of the lock rod (10), and an inside space of the shell body (20) along a direction of lock rod (10) has an accommodating space (21) and a shifting space (22) which are connected to each other. The accommodating space (21) is configured to accommodate the numeral wheels (11), and the shifting space is configured to accommodate the connecting piece (12). A sliding groove (23) horizontally penetrating the shifting space (22) is formed on the shell body (20), and the sliding groove (23) comprises an actuating opening (231) formed at a surface thereof. A fixing slot (24) formed on the shell body (20) is connected to the shifting space (22), and a bolt opening (241) extended from the fixing slot (24) is formed on a surface of a first end of the shell body (20). An inner wall of the fixing slot (24) comprises a plurality of protruding pieces (242) and at least a recessed portion (243), and a second through hole (25) is formed at a second end of the shell body (20). A second end of the lock rod (10) comprises a fixing rod (14) which is configured to connect to a locking cable (15) (as shown in FIG. 7), and the locking cable can be twined around immovable object to achieve a burglar-proof effect. The USB connector (30) is secured in the fixing slot (24) of the shell body (20), and a plurality of connecting holes (31) formed on the USB connector (30) is connected to the protruding pieces (242). Thus, the USB connector (30) can protrude from the bolt opening (241). Also, at least an elastic hooking member (32) formed on a surface of the USB connector (30) is curved toward an inner space of the USB connector (30). A rear end of the hooking member (32) has a blocking portion (321), and a push button (40) is located on the sliding groove (23) of shell body (20). Also, a head portion of the push button (40) protrudes from the actuating opening (231). The push button (40) penetrates through the first through hole (123) of the connecting piece (12), and an elastic member (41) bears against a first end of the push button (40). Thus, the connecting piece (12) can be pushed by the push button (40) to axially move in the shell body (20). A sloping surface (42) facing to the sloping portion (121) of the connecting piece (12) is formed at a side of the push button (40), and is configured to bear against the sloping portion (121) to move the connecting piece (12). The lock piece (50) is located inside of the USB connector (30), and an evading opening (51) is formed at a first end of the lock piece (50). Moreover, a second end of the lock piece (50) has a connecting portion (52), which is configured to engage with the engaging portion (122) of the connecting piece (12). In one embodiment, the engaging portion (122) of the connecting piece (12) and the connecting portion (52) of the lock piece (50) are engaged with each other in a method of dovetail joint. Thus, the connecting piece (12) and the lock piece (50) can quick connect to each other, and also the dovetail joint can prevent the connection between the connecting piece (12) and the lock piece (50) from axial disengagement. Furthermore, the second end of the lock piece (50) has at least an elastic unit (53) formed inside of the recessed portion (243) of the shell body (20). The movement of the connecting piece (12) can drive the lock piece (50) to move in the USB connector (30). Thus, when the lock piece (50) bears against the hooking member (32), the blocking portion (321) will be pushed outwardly to turn the combination lock into a lock position. On the other hand, when the blocking portion (321) of the hooking member (32) is aligned with the evading opening (51), the combination lock will be turn into a unlock position.

In actual application, referring to FIGS. 1 to 3, the push button is located at the first through hole (123) on the connecting piece (12) of the lock rod (10), and the lock rod (10) and the push button (40) are secured inside of the shell body (20). The numeral wheels (11) of the lock rod (10) are accommodated in the accommodating space (21) of the shell body (20), and the connecting piece (12) is located inside of the shifting space (22). Also, the push button (40) is secured in the sliding groove (23), and the head portion of the push button (40) protrudes from the actuating opening (231). The first end of the push button (40) penetrates through the first through hole (123), and the elastic member (41) is formed between the shell body (20) and the first end of the push button (40). The lock piece (50) is inserted into the USB connector (30), and the USB connector (30) is secured in the fixing slot (24) of the shell body (20). Also, the connecting holes of the USB connector (30) are connected to the protruding pieces (242) of the shell body (20). Thus, the USB connector (30) can protrude from the bolt opening (241) of the shell body (20). Meanwhile, in one embodiment, the connecting portion (52) of the lock piece (50) is engaged with the engaging portion (122) of the connecting piece (20) in the method of dovetail joint, resulting in the two components being able to quick connect to each other. The elastic unit (53) formed inside of the recessed portion (243) of the shell body (20) is configured to bear against the lock piece (50), and the fixing rod (14) of the lock rod (10) is accommodated in the second through hole (25). The last step of assembling process is to cover the shell body (20) around the lock rod (10), and then the lock rod (10) is secured inside of the shell body (20). When the combination lock of present invention is applied to an electronic device, referring to FIGS. 3 to 6, a user can press the push button (40) to move the sloping surface (42) of the push button (40), and then the sloping surface (42) will bear against the sloping portion (121) of the connecting piece (12) to move the connecting piece (12) forward. In this time, the lock rod (10) has not locked by the numeral wheels. Therefore, the connecting piece (12) can bear against the spring (13) toward the numeral wheels (11), and the lock piece (50) is moved by the connecting piece (12) simultaneously to align the evading opening (51) with the hooking member (32) of the USB connector (30). As a result, the blocking portion (321) of the hooking member (32) is pressed inwardly, and the USB connector (30) can directly connect to a USB port (A) of the electronic device. Also, after the USB connector (30) inserted to the USB port (A), the blocking portion (321) of the USB connector (30) will be engaged with the USB port (A). When the user releases the push button (40), the elastic member (41) can press the push button (40) to protrude from the actuating opening (231). Meanwhile, since the spring (13) and the elastic unit (53) can press the connecting piece (12) and the lock piece (50) back to their initial positions, when the push button (40) is in a released position, the lock piece (50) can block a bottom portion of the hooking member (32) of the USB connector (30). Therefore, the lock piece (50) will not be pressed inwardly by the blocking portion (321). Also, by shifting the numeral wheels (11), the connecting piece (12) can be turned into the lock position, leading to the combination lock of present invention achieving the burglarproof effect. As a result, by the locking process mention above, the electronic device can be locked by the USB combination lock of present invention without a design of specific lock hole. Furthermore, since the USB port is common to use in the electronic devices, the USB combination lock can be widely applied in the electronic devices. Additionally, in unlocking process, the user can shift the numeral wheels (11) back to an unlock position, and press the push button (40) to move the lock piece (50). Thus, the lock piece (50) can be removed from the bottom portion of the hooking member (32), and the USB connector (30) can be directly disconnected from the USB port (A). Moreover, when the USB connector (30) is inserted into the USB port (A) of the electronic device, the lock piece (50) can be secured by the lock rod (10), which is in the lock position. Thus, the lock piece (50) can block the hooking member (32), and the blocking portion (321) can engage with the USB port (A) to achieve the burglarproof effect. Also, when the USB combination lock is connected to an electronic device, the USB port (A) will be occupied. Thus, it can prevent date in electronic device from being copied by a USB or a portable external hard. Furthermore, since the USB port (A) is occupied, the electronic device will be less chance to be infected by an unsafe USB or an unsafe portable external hard drive. As a result, the USB combination lock of present invention can provide additional layer of security for the electronic device.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A USB combination lock for an electronic device comprising:

a lock rod comprising multiple numeral wheels side by side disposed thereon, and a first end of the lock rod connected to a connecting piece, and a spring formed between the connecting piece and the numeral wheels, a first end of the connecting piece closing to the spring having a sloping portion, and a second end thereof which is away from the spring comprising an engaging portion, a first through hole located between the sloping portion and the engaging portion formed at a central portion of the connecting piece;

a shell body having two symmetric shell pieces covering round outside of the lock rod, and an inside space of the shell body along a direction of lock rod having an accommodating space and a shifting space connected to each other, the accommodating space configured to accommodate the numeral wheels, and the shifting space configured to accommodate the connecting piece, a sliding groove which horizontally penetrates the shifting space formed on the shell body, and the sliding groove comprising an actuating opening formed at a surface thereof, a fixing slot formed on the shell body being connected to the shifting space, and a bolt opening which is extended from the fixing slot formed on a surface of a first end of the shell body;

a USB connector protruding from the bolt opening, also, at least an elastic hooking member which is formed on a surface of the USB connector curved toward an inner space of the USB connector, a rear end of the hooking member having a blocking portion;

a push button located on the sliding groove of shell body, and a head portion of the push button protruding from the actuating opening, the push button penetrating through the first through hole of the connecting piece, and an elastic member bearing against a first end of the push button, thus, the connecting piece can be pushed by the push button to axially move in the shell body; and a lock piece located inside of the USB connector, and a evading opening formed at a first end of the lock piece, a second end of the lock piece having a connecting portion which is configured to engage with the engaging portion of the connecting piece, the movement of the connecting piece driving the lock piece to move in the USB connector, thus, when the lock piece bearing against the hooking member, the blocking portion will be pushed outwardly to turn the combination lock into a lock position, on the other hand, when the blocking portion of the hooking member aligned with the evading opening, the combination lock will be turn into a unlock position.

2. The USB combination lock for the electronic device of claim 1, wherein a plurality of protruding pieces formed inside of the fixing slot of the shell body is configured to connect to a numeral of connecting holes formed at the USB connector.

3. The USB combination lock for the electronic device of claim 1, wherein at least a recessed portion is formed inside of the fixing slot of the shell body, and at least an elastic unit formed at the second end of the lock piece is accommodated inside of the recessed portion.

4. The USB combination lock for the electronic device of claim 1, wherein a sloping surface facing to the sloping portion of the connecting piece is formed at a side of the push button, and is configured to bear against the sloping portion to move the connecting piece.

5. The USB combination lock for the electronic device of claim 1, wherein the engaging portion of the connecting piece and the connecting portion of the lock piece are engaged with each other in a method of dovetail joint.

6. The USB combination lock for the electronic device of claim 1, wherein a second through hole is formed at a second end of the shell body which is far from the bolt opening, and second end of the lock rod comprises a fixing rod which is configured to connect to a locking cable, wherein the locking cable can be twined around immovable object to achieve a burglarproof effect.

* * * * *